US007201645B2

(12) United States Patent
Sung

(10) Patent No.: US 7,201,645 B2
(45) Date of Patent: Apr. 10, 2007

(54) CONTOURED CMP PAD DRESSER AND ASSOCIATED METHODS

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 255 days.

(21) Appl. No.: 10/954,956

(22) Filed: Sep. 29, 2004

(65) Prior Publication Data

US 2005/0095959 A1 May 5, 2005

Related U.S. Application Data

(63) Continuation-in-part of application No. 10/109,531, filed on Mar. 27, 2002, now Pat. No. 6,884,155, which is a continuation-in-part of application No. 09/558,582, filed on Apr. 26, 2000, now Pat. No. 6,368,198, which is a continuation-in-part of application No. 09/447,620, filed on Nov. 22, 1999, now abandoned.

(51) Int. Cl.
*B24B 21/18* (2006.01)

(52) U.S. Cl. ..... 451/443; 451/41; 451/56; 451/285

(58) Field of Classification Search ..... 451/41, 451/56, 443, 444, 285–290, 526, 539, 540, 451/548

See application file for complete search history.

(56) References Cited

U.S. PATENT DOCUMENTS

| | | | |
|---|---|---|---|
| 187,593 | A | 2/1877 | Brown |
| 1,988,065 | A | 1/1935 | Wooddell |
| 2,078,354 | A | 4/1937 | Webster |
| 2,268,663 | A | 1/1942 | Kuzmick |
| 2,612,348 | A | 9/1952 | Catallo |
| 2,811,960 | A | 11/1957 | Fessel |
| 2,867,086 | A | 1/1959 | Haley |
| 2,876,086 | A | 3/1959 | Raymond |
| 2,952,951 | A | 9/1960 | Simpson |
| 3,067,551 | A | 12/1962 | Maginnis |
| 3,121,981 | A | 2/1964 | Hurst |
| 3,127,715 | A | 4/1964 | Christensen |
| 3,276,852 | A | 10/1966 | Lemelson |
| 3,293,012 | A | 12/1966 | Smiley |
| 3,630,699 | A | 12/1971 | Catlin |
| 3,802,130 | A | 4/1974 | Lindenbeck |
| 3,894,673 | A | 7/1975 | Lowder |

(Continued)

FOREIGN PATENT DOCUMENTS

| | | |
|---|---|---|
| EP | 0 238 434 | 9/1987 |

(Continued)

OTHER PUBLICATIONS

Yasunaga, N. et al. (2000) Advances in Abrasive Technology, III Soc. Of Grinding Engineers (SGE) in Japan.

*Primary Examiner*—Lee D. Wilson
*Assistant Examiner*—Anthony Ojini
(74) *Attorney, Agent, or Firm*—Thorpe North & Western, LLP

(57) ABSTRACT

CMP pad dressers with increased pad dressing work loads on the centrally located abrasive particles during dressing of a CMP pad, and methods associated therewith are disclosed and described. The increase in work load on centralized particles improves pad dressing performance and also extends the service life of the pad dresser.

62 Claims, 4 Drawing Sheets

U.S. PATENT DOCUMENTS 3,982,358 A 9/1976 Fukuda
4,018,576 A 4/1977 Lowder et al.
4,211,924 A 7/1980 Muller et al.
4,341,532 A 7/1982 Oide
4,355,489 A 10/1982 Heyer et al.
4,565,034 A 1/1986 Sekiya
4,669,522 A 6/1987 Griffin
4,680,199 A 7/1987 Vontell et al.
4,780,274 A 10/1988 Barr
4,883,500 A 11/1989 Deakins et al.
4,908,046 A 3/1990 Wiand
4,916,869 A 4/1990 Oliver
4,925,457 A 5/1990 deKok et al.
4,945,686 A 8/1990 Wiand
4,949,511 A 8/1990 Endo et al.
4,968,326 A 11/1990 Wiand
5,000,273 A 3/1991 Horton et al.
5,022,895 A 6/1991 Wiand
5,030,276 A 7/1991 Sung et al.
5,049,165 A 9/1991 Tselesin
5,092,082 A 3/1992 Padberg et al.
5,092,910 A 3/1992 deKok et al.
5,131,924 A 7/1992 Wiand
5,133,782 A 7/1992 Wiand
5,164,247 A 11/1992 Solanki et al.
5,190,568 A 3/1993 Tselesin
5,197,249 A 3/1993 Wiand
5,203,881 A 4/1993 Wiand
5,246,884 A * 9/1993 Jaso et al. ..... 438/693
5,264,011 A 11/1993 Brown
5,266,236 A 11/1993 Bovenkerk
5,271,547 A 12/1993 Carlson
5,380,390 A 1/1995 Tselesin
5,453,106 A 9/1995 Roberts
5,518,443 A 5/1996 Fisher
5,527,424 A * 6/1996 Mullins ..... 438/692
5,609,286 A 3/1997 Anthon
5,620,489 A 4/1997 Tselesin
5,746,931 A * 5/1998 Graebner et al. ..... 216/88
RE35,812 E 6/1998 Oliver
5,791,975 A 8/1998 Cesna et al.
5,816,891 A 10/1998 Woo
5,820,450 A 10/1998 Calhoun
5,833,519 A 11/1998 Moore
5,885,137 A 3/1999 Ploessl
5,902,173 A 5/1999 Tanaka
5,916,011 A 6/1999 Kim et al.
5,921,856 A 7/1999 Zimmer
5,961,373 A 10/1999 Lai et al.
6,001,008 A 12/1999 Fujimori et al.
6,106,382 A * 8/2000 Sakaguchi ..... 451/443
6,123,612 A * 9/2000 Goers ..... 451/540
6,190,240 B1 2/2001 Kinoshita et al.
6,213,856 B1 4/2001 Cho et al.
6,286,498 B1 9/2001 Sung
6,325,709 B1 12/2001 Nanda et al.
6,368,198 B1 4/2002 Sung et al.
6,394,886 B1 5/2002 Chen et al.
6,409,580 B1 6/2002 Lougher et al.
6,551,176 B1 4/2003 Garretson
6,607,423 B1 8/2003 Arcayan et al.

FOREIGN PATENT DOCUMENTS

EP 0 264 674 4/1988
EP 0 331 344 9/1989
JP 10128654 A 5/1998
JP 10180618 A 7/1998
JP 11048122 A 2/1999
JP 11077536 A 3/1999
WO 98/10897 3/1998
WO 98/45091 10/1998
WO 98/45092 10/1998
WO 98/51448 11/1998

* cited by examiner

CONTOURED CMP PAD DRESSER AND ASSOCIATED METHODS

PRIORITY DATA

This patent application is a continuation-in-part of U.S. patent application Ser. No. 10/109,531 filed Mar. 27, 2002, now U.S. Pat. No. 6,884,155 which is a continuation-in-part of U.S. patent application Ser. No. 09/558,582 filed Apr. 26, 2000, which has now issued as U.S. Pat. No. 6,368,198 which is a continuation-in-part of U.S. patent application Ser. No. 09/447,620 filed Nov. 22, 1999, now abandoned, each of which is incorporated herein by reference in their entirety.

FIELD OF THE INVENTION

The present invention relates generally to a device and methods for dressing or conditioning a chemical mechanical polishing (CMP) pad. Accordingly, the present invention involves the chemical and material science fields.

BACKGROUND OF THE INVENTION

Many industries are now using a chemical mechanical process (CMP) for polishing certain work pieces. Particularly, the computer manufacturing industry has begun to rely heavily on CMP processes for polishing wafers of ceramics, silicon, glass, quartz, and metals thereof. Such polishing processes generally entail applying the wafer against a rotating pad made from a durable organic substance such as polyurethane. To the pad, is added a chemical slurry containing a chemical capable of breaking down the wafer substance, and an amount of abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles throughout the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, and to keep the fibers as erect as possible, or to assure that there are an abundance of openings and pores available to receive new abrasive particles.

A problem with maintaining the top of the pad is caused by an accumulation of polishing debris coming from the work piece, abrasive slurry, and dressing disk. This accumulation causes a "glazing" or hardening of the top of the pad, and mats the fibers down, thus making the pad less able to hold the abrasive particles of the slurry, and significantly decreasing the pad's overall polishing performance. Further, with many pads, the pores used to hold the slurry, become clogged, and the overall asperity of the pad's polishing surface becomes depressed and matted. Therefore, attempts have been made to revive the top of the pad by "combing" or "cutting" it with various devices. This process has come to be known as "dressing" or "conditioning" the CMP pad. Many types of devices and processes have been used for this purpose. One such device is a disk with a plurality of super hard crystalline particles, such as diamond particles attached to a surface, or substrate thereof.

Unfortunately, such abrasive disks made by conventional methods exhibit several problems. First, abrasive particles may dislodge from the substrate of the disk and become caught in the CMP pad fibers. This leads to scratching and ruin of the work piece being polished. Second, the production methods of the past tend to produce disks having abrasive particles that are clustered in unevenly spaced groups on the surface of the substrate. The resultant non-uniform spacing between particles causes some portions of the CMP pad to be overdressed which creates wear marks, while others are underdressed which creates glazing layers. Third, the abrasive particles of these disks are not configured to penetrate the pad to a uniform depth. This non-uniformity creates additional uneven dressing of the CMP pad. Finally, depending on the degree to which the CMP pad is flexible, it may tend to bulge or bubble in front of the initial leading edge of the dresser due to the downward force exerted by the dresser. Such bulging may cause a depression of the pad to occur as it passes under the remaining portion of the dresser, which may in turn, cause the remaining abrasive particles, especially those that are centrally located on the pad dresser to penetrate the pad less deeply or even skip over the pad entirely. This uneven work load on the dresser particles may cause the pad to be unevenly dressed, and may also cause the dresser to wear unevenly and become worn out prematurely.

Yet another disadvantage with modern CMP pad dressers is reduced service life of the pad conditioner. The effectiveness and efficiency of the service of a CMP pad conditioner is determined by its number of working abrasive particles and the amount of work that is experienced by each particle. As noted above, the service life of a pad conditioner can be reduced by an uneven distribution of work load on the superabrasive particles. When a flexible CMP pad depresses under the pressure of a dresser excessive wear may occur on the leading edge crystals of the pad conditioner as they will bear the majority of the work load. Further, the centrally located abrasive particles are prevented from receiving an equal work load. This work load mismatch increases the wear rate on the leading edge particles and can cause the dresser to become unusable long before the exhaustion of the centrally located particles.

With respect to particle retention, two factors tend to cause the abrasive particles to dislodge from the pad dresser disks of the prior art. First, dislodging often occurs due to the inferior method by which the abrasive particles have been attached. Abrasive particles held to the substrate only by electroplated nickel or other overlay materials are secured only by weak mechanical forces and not by any form of chemical bonding. Hence, these particles become easily dislodged upon exposure to strong mechanical forces such as friction. Furthermore, particle dislodging is facilitated by the chemical attack on the electroplating material which is presented by the chemical slurry.

In contrast, when the abrasive particles are brazed onto the substrate, a chemical bond holds the particles more firmly. However, the acids of the chemical slurry can quickly weaken the braze-particle bonds and dislodge the abrasive particles under the friction of pad dressing. Therefore, to minimize the exposure of the braze to the chemicals and extend the useful life of the pad dresser, the polishing processes must be halted while dressing occurs. The resultant sequence of alternating polishing and then dressing wastes time, and is inefficient.

Warping of the pad dresser working surface during the brazing process also often causes abrasive particles to dislodge. During the brazing process the pad dresser must be exposed to very high temperatures. Exposure to this extreme heat can cause the working surface of the pad dresser to warp, thus compromising the smoothness and planarity of the pad dresser's working surface. As a result, the braze portion of the working surface will be rough, having high and low spots. Such spots are undesirable, as they may cause the braze to begin flaking off, and making micro-scratches on the polished surface of the work piece. Further, such unevenness may cause issues with further processing of the dresser, and abrasive particle retention.

In view of the foregoing, a CMP pad dresser that is constructed and configured to achieve optimal dressing results, with maximized efficiency and lifespan continues to be sought.

SUMMARY OF THE INVENTION

Accordingly, in one aspect, the present invention provides methods and CMP pad dresser configurations for increasing the work load on centrally located superabrasive particles in a CMP pad dresser during dressing of a CMP pad. In one such method, a CMP pad dresser is provided which has a plurality of superabrasive particles each coupled to a substrate member and held at specific locations in accordance with a predetermined pattern. The superabrasive particles can be configured in a pattern that reduces the penetration of peripherally located particles into the CMP pad and increases penetration of centrally located particles into the CMP pad, thus optimizing the work load placed on the centrally located superabrasive particles. Generally, the particles are of a super hard substance such as diamond, or cubic boron nitride (cBN), in either the single crystal or polycrystalline form.

In one embodiment of the present invention, the method for increasing the work load on centrally located superabrasive particles includes the utilization of a CMP pad dresser having a substrate with superabrasive particles configured in a pattern that provides a slope from the working ends of the peripherally located particles upwardly to the working ends of the centrally located particles. Further, the exact degree of slope employed can be configured to control the work load experienced by the centrally located particles. Such a slope can be created in various ways. For example, in one aspect, a slope can be created by disposing superabrasive particles on or in a substantially flat substrate, where the superabrasive particles increase in height above a working surface of the substrate from the peripherally located particles to the centrally located particles. In some cases, the preferred degree of slope can be determined as a measure of pad velocity and pad flexibility.

In yet another embodiment of the present invention, a method for increasing the work load on the centrally located particles may include providing a CMP pad dresser having a plurality of superabrasive particles coupled to a substrate in a pattern that places the peripherally located superabrasive particles at a higher density than the centrally located particles. It has been found that particles clustered in a higher density are unable to penetrate into the pad as deeply as those spaced farther apart from one another. Therefore, by varying densities of particles on the substrate work load can be transferred from one area to another.

In still another embodiment of the present invention a method of increasing the work load on centrally located particles may be achieved by orienting the centrally located particles with an attitude that causes higher particle penetration into the CMP pad than penetration provided by an attitude of the peripherally located particles. In one aspect, the attitude of the centrally located particles can present an apex at the working end thereof, and the attitude of the peripherally located particles can present either a face or an edge at the working end thereof. In another aspect, the attitude of the centrally located particles can present an edge at the working end thereof, and the attitude of the peripherally located particles can present a face at the working end thereof. In yet another aspect, when the attitude of the centrally located particles presents an apex at the working end thereof, the attitude of the peripherally located particles can present a face at the working end thereof, and the attitude of any particles in between those peripherally and centrally located can present an edge at the working end thereof.

In addition to the above-recited methods of use, the present invention also includes methods for producing a CMP pad dresser that displays an increased work load on the centrally located superabrasive particles. Generally speaking, such a method includes the steps of: 1) providing a substrate; and 2) attaching a plurality of superabrasive particles on to the substrate in a pattern that reduces the penetration of peripherally located particles into the CMP pad and increases the penetration of the centrally located particles into the CMP pad.

Using the methods described above, CMP pad dressers exhibiting considerable advantages may be created. For example, the working surface of the CMP pad dresser may be configured to increase the contact of the CMP pad under a central portion of the dresser, rather than overly contacting an outside or "leading edge" thereof. Such increased central contact transfers a portion of the work load from the peripheral area of the dresser to the central area of the dresser, thus lengthening the service life of the dresser and allowing the dresser to more effectively cut into and groom the pad. CMP pad dressers that incorporate such configurations are encompassed by the present invention, including those with specific configurations made to support the methods recited above.

The above-recited features and advantages of the present invention will become apparent from a consideration of the following detailed description presented in connection with the accompanying drawings.

DETAILED DESCRIPTION OF THE INVENTION

Figure 1:
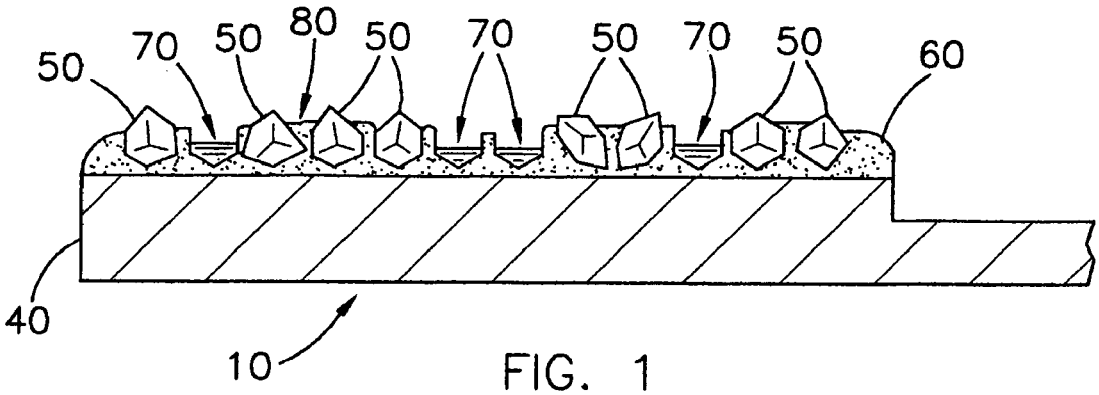
FIG. 1 (PRIOR ART)
FIG. 1 is a side view of a prior art CMP pad dresser employing an electroplating method for fixing the abrasive particles to the disk substrate in accordance with one embodiment of the present invention.

Before the present CMP pad dresser and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to an "abrasive particle" or a "grit" includes reference to one or more of such abrasive particles or grits.

Definitions

In describing and claiming the present invention, the following terminology will be used in accordance with the definitions set forth below.

As used herein, "abrasive particle," or "grit," or similar phrases mean any super hard crystalline, or polycrystalline substance, or mixture of substances and include but is not limited to diamond, polycrystalline diamond (PCD), cubic boron nitride, and polycrystalline cubic boron nitride (PCBN). Further, the terms "abrasive particle," "grit," "diamond," "polycrystalline diamond (PCD)," "cubic boron nitride," and "polycrystalline cubic boron nitride, (PCBN)," may be used interchangeably.

As used herein, "substrate" means a portion of a CMP dresser which supports abrasive particles, and to which abrasive particles may be affixed. Substrates useful in the present invention may be any shape, thickness, or material, that is capable of supporting abrasive particles in a manner that is sufficient provide a tool useful for its intended purpose. Substrates may be of a solid material, a powdered material that becomes solid when processed, or a flexible material. Examples of typical substrate materials include without limitation, metals, metal alloys, ceramics, and mixtures thereof. Further the substrate may include brazing alloy material.

As used herein, "working surface" means the surface of a CMP pad dresser that, during operation, faces toward, or comes in contact with a CMP pad.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "sharp portion" means any narrow portion to which a crystal may come, including but not limited to corners, ridges, edges, obelisks, and other protrusions.

As used herein, "centrally located particle" means any particle of a dresser that under normal dressing circumstances receives a reduced work load as compared to a peripherally located particle. In some aspects, "central" or "centrally located" refers to an area of a dresser that originates at a center point of the dresser and extends outwardly towards the dresser's edge for up to about 90% of the radius of the dresser. In some aspects, the area may extend outwardly from about 20% to about 90% of the radius. In other aspects, the area may extend out to about 50% of the radius. In yet another aspect, the area may extend out to about 33% of the radius of a dresser.

As used herein, "peripherally located" means any particle of a dresser that under normal dressing circumstances that receives an excess work load as compared to the centrally located particles. In some aspects, "periphery" or "peripheral" or "peripherally located" may refer to an area that originates at the leading edge or outer rim of a dresser and extends inwardly towards the center for up to about 90% of the radius of the dresser. In some aspects, the area may extend inwardly from about 20% to 90% of the radius. In other aspects, the area may extend in to about 50% of the radius. In yet another aspect, the area may extend in to about 33% of the radius of a dresser (i.e. 66% away from the center).

As used herein, "work load" means the amount of work or force exerted on a particle in a dresser during use of the dresser.

As used herein, "working end" refers to an end of a particle which is oriented towards the CMP pad and during a dressing operation makes contact with the pad. Most often the working end of a particle will be distal from a substrate to which the particle is attached.

As used herein, "amorphous braze" refers to a homogenous braze composition having a non-crystalline structure. Such alloys contain substantially no eutectic phases that melt incongruently when heated. Although precise alloy composition is difficult to ensure, the amorphous brazing alloy as used herein should exhibit a substantially congruent melting behavior over a narrow temperature range.

As used herein, "alloy" refers to a solid or liquid mixture of a metal with a second material, said second material may be a non-metal, such as carbon, a metal, or an alloy which enhances or improves the properties of the metal.

As used herein, "metal brazing alloy," "brazing alloy," "braze alloy," "braze material," and "braze," may be used interchangeably, and refer to a metal alloy which is capable of chemically bonding to superabrasive particles, and to a matrix support material, or substrate, so as to substantially bind the two together. The particular braze alloy components and compositions disclosed herein are not limited to the particular embodiment disclosed in conjunction therewith, but may be used in any of the embodiments of the present invention disclosed herein.

As used herein, the process of "brazing" is intended to refer to the creation of chemical bonds between the carbon atoms of the superabrasive particles and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond.

Therefore, brazing of a superabrasive segment to a tool body does not require the presence of a carbide former.

As used herein, "superabrasive particles" and "superabrasive grits" may be used interchangeably, and refer to particles of either natural or synthetic diamond, super hard crystalline, or polycrystalline substance, or mixture of substances and include but are not limited to diamond, polycrystalline diamond (PCD), cubic boron nitride (CBN), and polycrystalline cubic boron nitride (PCBN). Further, the terms "abrasive particle," "grit," "diamond," "PCD," "CBN," and "PCBN," may be used interchangeably.

As used herein, in conjunction with the brazing process, "directly" is intended to identify the formation of a chemical bond between the superabrasive particles and the identified material using a single brazing metal or alloy as the bonding medium.

As used herein, "asperity" refers to the roughness of a surface as assessed by various characteristics of the surface anatomy. Various measurements may be used as an indicator of surface asperity, such as height of peaks or projections thereon, and the depth of valleys or concavities depressing therein. Further, measures of asperity include the number of peaks or valleys within a given area of the surface (i.e. peak or valley density), and the distance between such peaks or valleys.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "metallic" means any type of metal, metal alloy, or mixture thereof, and specifically includes but is not limited to steel, iron, and stainless steel.

As used herein, "grid" means a pattern of lines forming multiple squares.

As used herein with respect to distances and sizes, "uniform" refers to dimensions that differ by less than about 75 total micrometers.

As used herein, "Ra" refers to a measure of the roughness of a surface as determined by the difference in height between a peak and a neighboring valley. Further, "Rmax" is a measure of surface roughness as determined by the difference in height between the highest peak on the surface and the lowest valley on the surface.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1–3, from 2–4, and from 3–5, etc. This same principle applies to ranges reciting only one numerical value. Furthermore, such an interpretation should apply regardless of the breadth of the range or the characteristics being described.

The Invention

Applicant has discovered devices and methods for improving the efficiency and quality of conditioning or dressing a CMP pad. By using the device to condition or dress a CMP pad, not only is the pad life extended, but also the constancy at which the pad may be used, and therefore, the speed at which the device accomplishes its work is improved.

Referring now to FIG. 1, there is shown a prior art CMP pad dresser 10, which has a plurality of abrasive particles 50 electroplated to a substrate 40. The electroplating material 60, is generally nickel precipitated out of an acid solution.

CMP pad dressers 10 using only the electroplating material 60 to attach the abrasive particles 50 to a substrate have many disadvantages that are apparent as shown in FIG. 1. First, the electroplating material is incapable of forming chemical bonds with the abrasive particles. Therefore, only weak mechanical forces hold the abrasive particles onto the substrate 40. When the pad dresser is rotated against a CMP pad, such mechanical forces are quickly overcome by the friction force acting on the abrasive particles. As a result the abrasive particles are easily loosened from the electroplating material, leaving voids in the electroplating material, such as spaces 70. Such voids are quickly filled with residue polished off of the work piece, as well as chemicals and abrasive particles from the slurry. These substances chemically attack and further weaken the electroplating material.

Because the mechanical forces created by the electroplating material 60 are the only means holding the abrasive particles 50 onto the substrate 40, exposure of the abrasive particles above the electroplating material must be kept to a minimum. Nevertheless, contact between electroplating material and the CMP pad is inevitable. Such contact wears the electroplating material and further facilitates the release of the abrasive particles. Additionally, during manufacture, the electroplating material tends to bubble up around the abrasive particles, in places such as convex portion 80. These convex portions, in addition to the already low exposure and tight spacing of the abrasive particles, make significant penetration of the abrasive particles into the CMP pad fibers difficult, if not impossible. Without such penetration, the effectiveness of the dressing process is handicapped.

Figure 2:
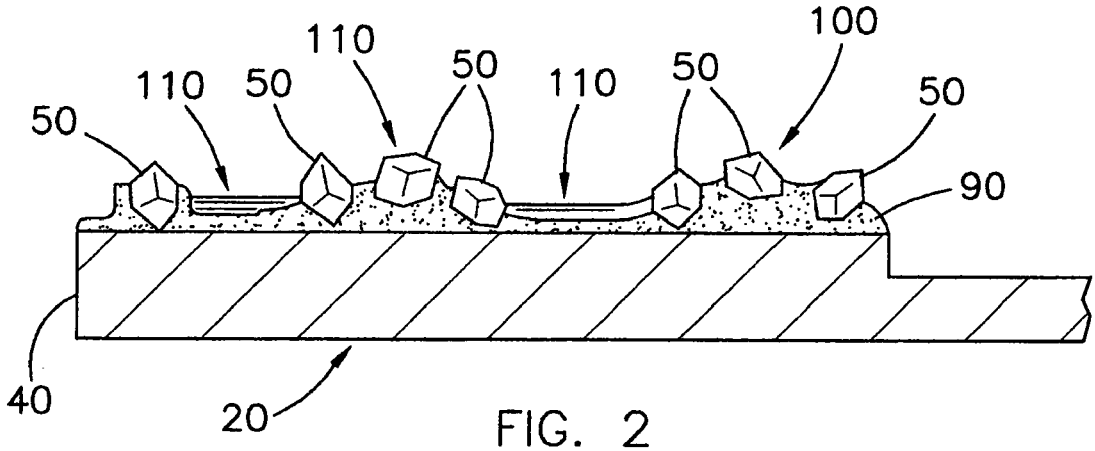
FIG. 2 (PRIOR ART)
FIG. 2 is a side view of a prior art CMP pad dresser made by using a traditional brazing method for fixing the abrasive particles to the disk substrate.

Referring now to FIG. 2, there is shown a prior art CMP dresser pad 20 with a substrate 40, having abrasive particles 50, brazed to the substrate, using a brazing material 90, and conventional vacuum furnace brazing techniques. Brazing materials 90 generally comprise a metal alloy mixed with carbide formers. Such carbide formers allow the abrasive particles to chemically bond to the brazing material which in turn bonds with the substrate. This bonding arrangement significantly increases the overall strength of the CMP dresser, but is accompanied by some undesirable side effects.

Brazing material 90 must be kept to a minimum in order to avoid completely covering the abrasive particles 50. Therefore, the abrasive particles are wrapped in only a thin coating of brazing material. This problem is compounded by the fact that typical brazing materials are mechanically very weak. This mechanical weakness offsets the strength of the chemical bonds created between the abrasive particles and the brazing material. In fact, when dislodgment occurs, the chemical bonds between the abrasive particles and the brazing material are strong enough that the brazing material itself will often shear off along with detached abrasive particles.

The brazing material 90 is also very susceptible to chemical attack by the abrasive slurry. This contributes to the detachment of abrasive particles 50, as it further weakens the brazing material, which is already mechanically weak. Therefore, in order to reduce exposure of the CMP pad dresser 20 to the chemical slurry, polishing of the work piece must be paused, and the chemical slurry allowed to leave the pad before the pad dresser is applied. Such pauses in the polishing process greatly reduce the constancy with which the pad may be used, increase the time required to produce a finished product, and are therefore inefficient.

Another drawback to coupling the abrasive particles 50 to a substrate 40 by conventional brazing alone is that the surface tension of the molten metal alloy tends to cause the abrasive particles to "cluster" when applied to the substrate. Such clustering is illustrated at 100, leaving unintended gaps 110. The overall effect is a non-uniform distribution of abrasive particles, which makes grooming inefficient. Further, the gaps cause uneven conditioning of the pad, which ultimately wears out certain areas of the CMP pad faster than others, with the overall result that the work piece will receive an uneven polish because the worn out areas polish less effectively than the properly conditioned areas.

The clustering of abrasive particles creates another disadvantage by forming mounds in the brazing material 90. Mound formation raises some abrasive particles to a height above the substrate 40, which is greater than that of other abrasive particles. Therefore, the highest protruding abrasive particles may penetrate so deeply into the fibers of the CMP pad, that they will prevent lesser protruding abrasive particles from contacting the CMP pad or having a useful grooming effect.

Figure 3:
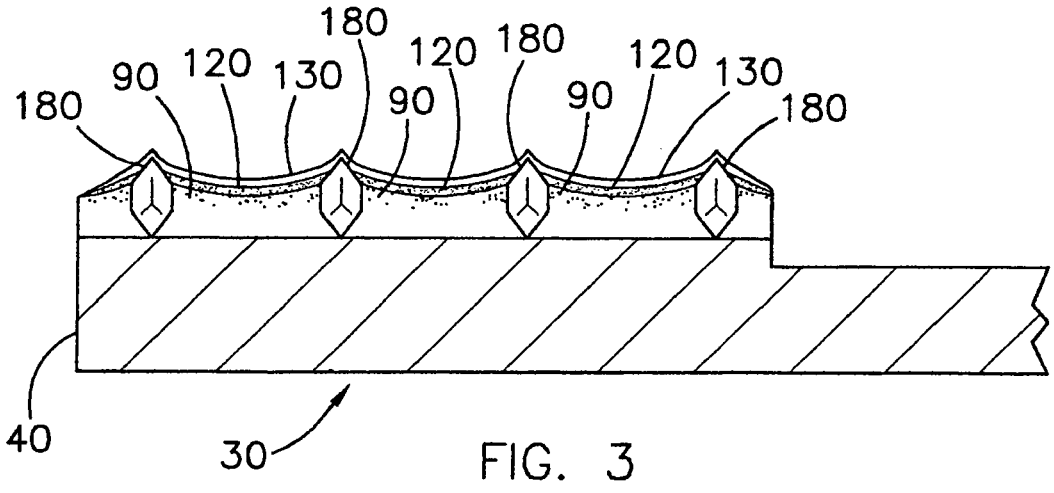
FIG. 3 is a side view of a CMP pad dresser made in accordance with one embodiment of the present invention.

In contrast to the CMP pad dressers of the prior art, the present invention allows even dressing of the CMP pad. Referring now to FIG. 3, there is shown a CMP pad dresser 30 made in accordance with the principles of the present invention. The CMP pad dresser has a plurality of abrasive particles 50 coupled to a substrate 40 with a brazing material 90.

Abrasive particles 50 may be of a variety of super hard materials. Examples of such materials include without limitation, diamond, polycrystalline diamond (PCD), cubic boron nitride (CBN) and polycrystalline cubic born nitride (PCBN).

Additionally shown in FIG. 3, is a layer of an overlay material 120, which is applied after the final brazing process. As recited above, the overlay provides a working surface that is substantially smoother than the working surface of the brazing alloy. Such smoothness and planarity provides a number of benefits, including reduced incidence of micro-scratching from flaking braze, and better bonding with the anti-corrosive layer when included. In one aspect, the working surface of the overlay material may have an Ra value of less than about 1 micrometer.

A number of suitable overlay materials may be used. However, in one aspect, the overlay materials include, without limitation, tin, nickel, tungsten, cobalt, chromium, and alloys thereof, such as a zirconium nickel alloy. The overlay material may be applied by a wide variety of methods. Examples of methods for applying the overlay material include without limitation, electroplating and physical vapor deposition (PVD). The layer of overlay material may be of any thickness required to achieve a specific result, but in one aspect of the invention the layer may have a thickness of from about 0.1 to 50 micrometers thick. In another aspect, the thickness of the overlay may be from about 0.1 to about 5 micrometers.

Further illustrated in FIG. 3, is an anti-corrosive layer 130. The optional anti-corrosive layer is formed over the surface of the CMP pad dresser after the abrasive particles 50 have been affixed to the substrate 40. In one aspect, the anti-corrosive layer may be a super abrasive material such as diamond-like carbon (DLC), or amorphous diamond. In one embodiment, the anti-corrosive layer has an atomic carbon content of at least about 80%. Additionally, while the anti-corrosive layer may have a variety of thicknesses as required to achieve a specific result, generally the thickness is in the range of 0.5 to 5 micrometers. In one aspect, the anti-corrosive layer has a thickness less than 3 micrometers. Such a thin anti-corrosive layer ensures that the working surface of the CMP pad dresser is protected without reducing the ability of the abrasive particles to dress the CMP pad. The anti-corrosive layer is generally produced by use of a physical vapor deposition (PVD) method. PVD methods such as the use of a cathodic arc with a graphite cathode, which is generally known in the art.

One advantage provided by the anti-corrosive layer 130, is that it effectively "seals" the working surface, and may also seal any other desired surfaces of the CMP pad dresser 30 that may be vulnerable to chemical attack. As a sealant, the anti-corrosive layer protects the brazing material 90 from chemical attack by the abrasive chemical slurry held within the CMP pad. This protection allows CMP pad dresser to dress a CMP pad in situ, and eliminates the production pauses used to prolong the useful life of prior art CMP pad dressers. The continual and even dressing of the CMP pad allows for greater production output, and prolongs the life and efficiency of the CMP pad.

While the anti-corrosive layer 130 may be used in some embodiments of the present invention, it is notable that the overlay material 120 has significant anti-corrosive characteristics in and of itself. As such, many of the production advantages may be obtained to a substantial degree, only when the overlay material is used, and without the use of the anti-corrosive layer.

Figure 4:
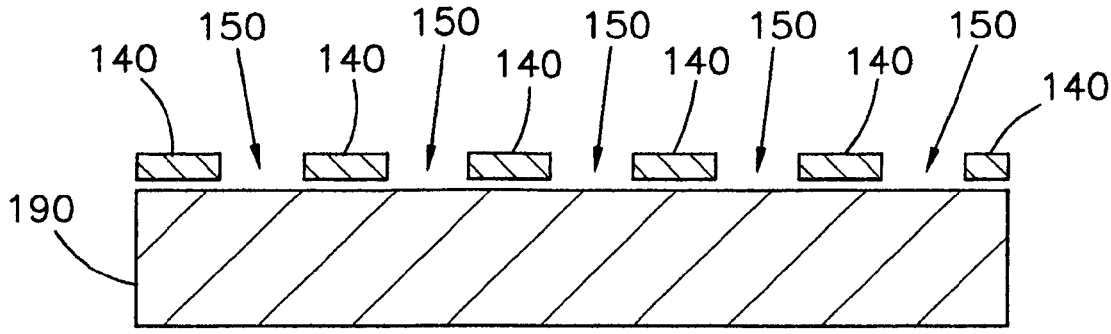
FIG. 4 is a side view of a sheet of brazing alloy with a template for placing abrasive particles on the surface thereof in accordance with one embodiment of the present invention.
Figure 5:
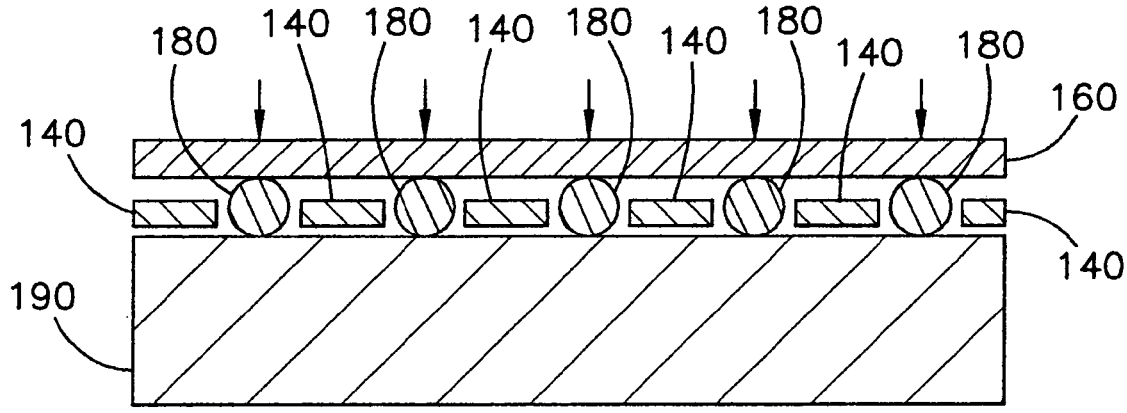
FIG. 5 is a side view of a sheet of brazing alloy with a template on its surface, and abrasive particles filling the apertures of the template. A flat surface is shown for use in pressing the abrasive particles into the sheet of brazing alloy in accordance with one embodiment of the present invention.
Figure 6:
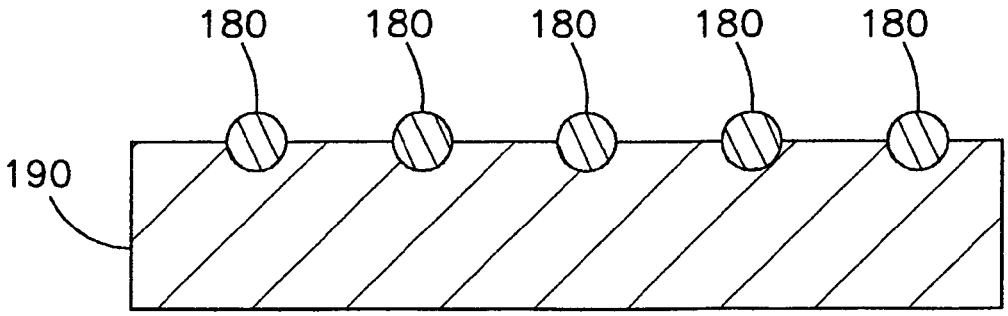
FIG. 6 is a side view of a sheet of brazing alloy having abrasive particles pressed into it in accordance with one embodiment of the present invention.

One method of affixing abrasive particles 180 to a substrate is shown in FIGS. 4–6. First, a template 140 having apertures 150 is placed upon a sheet of brazing alloy 190. In one aspect of the present invention, the sheet may be a rolled sheet of continuous amorphous brazing alloy. In another aspect, the sheet may be a brazing alloy powder that is held together with a binder material. In an additional aspect, the brazing alloy powder may include other metallic powders, and such other powders may constitute a majority of the material in the brazing sheet. In yet another aspect, the sheet may be sufficient to act as a substrate. The use of the template allows controlled placement of each abrasive particle at a specific location by designing the template with apertures in a desired pattern.

After the template 140 is place on the brazing alloy sheet 190, the apertures 150 are filled with abrasive particles 180. The apertures have a predetermined size, so that only one abrasive particle will fit in each. Any size of abrasive particle or grit is acceptable, however in one aspect of the invention, the particle sizes may be from about 100 to about 350 micrometers in diameter.

In another aspect of the invention, the size of the apertures in the template may be customized in order to obtain a pattern of abrasive particles having a size within a uniform in size range. In one embodiment, the apertures of the template are sufficient to select only grits within a size range having a variance no greater than 50 micrometers. This uniformity of grit size contributes to the uniformity of CMP pad grooming, as the work load of each abrasive particle is evenly distributed. In turn, the even work load distribution reduces the stress on individual abrasive particles, and extends the effective life of the CMP pad dresser.

After the apertures of the template 150 are all filled with grits 180, any excess abrasive particles are removed, and a flat surface 160 is applied to abrasive particles. The flat surface 160 must be of an extremely strong, rigid material, so that it is capable of pushing abrasive particles down into the brazing alloy sheet 190. Such materials typically include, but are not limited to steel, iron, alloys thereof, etc.

Abrasive particles 180 are shown to be embedded in brazing alloy sheet 190 in FIG. 6. Because surface 160 was flat, the abrasive particles will extend away from the substrate to a predetermined, uniform height. This uniform height will be determined by the thickness of template 140, and in a preferred embodiment, each abrasive particle will extend to within 50 micrometers of this distance. As such, each abrasive particle grooms to substantially the same depth on the CMP pad. However, it is to be understood that in certain applications, grit height may not be desired to be uniform. As such, those of ordinary skill in the art will recognize that grit patterns of varied height may be provided by so configuring the template, 140 and the surface 160 to provide such a design. For example, in one aspect, the surface 160 may have a concave shape so as to press the peripherally located particles further down than the centrally located particles. As can be seen, such a concave shape will provide a slope for the abrasive particles which begins at a low point with the working ends of the peripherally particles and slopes up to a high point at the working ends of the centrally located particles.

Abrasive particles 180 as shown in FIGS. 4–6 are rounded. However, in FIG. 3, they are pointed. The scope of the present invention encompasses abrasive particles of any shape, including euhedral, octahedral, cubo-octaheral, or naturally shaped particles. However, in one embodiment, the abrasive particles have a predetermined shape with a sharp point or apex extending in a direction away from the substrate 40.

In an alternative embodiment, rather than pressing the abrasive particles 180 into the brazing alloy sheet 190, they may be fixed in the templated position by disposing an adhesive on the surface of the brazing alloy sheet. In this manner, the particles remain fixed in place when the template is removed, and during heat processing. In yet another embodiment of the invention, the template 140 may be laid upon a transfer sheet (not shown) having a thin adhesive film thereon. In this case, the particles become adhered to the transfer sheet using the template procedure specified above. The template is then removed, and the transfer sheet is laid onto the brazing sheet 190 with abrasive particles facing the sheet. Disposed upon the brazing sheet is the afore-mentioned adhesive layer, which is more strongly adhesive than the adhesive on the transfer sheet. Therefore, the abrasive particles are transferred to the sheet of brazing alloy in the pattern dictated by the template.

After the abrasive particles 180 are at least partially embedded in, or adhered to, the brazing alloy sheet 190, the sheet is affixed to the substrate 40 as shown in FIG. 3. Alternatively, in some embodiments, the sheet of brazing alloy may be first affixed to the substrate, and the abrasive particles subsequently added thereto using the template procedure described herein. The brazing alloy used may be any brazing material known in the art, but in one aspect, may be a nickel alloy that has a chromium content of at least 2% by weight. A brazing alloy of such a composition will be nearly super hard in and of itself, and less susceptible to chemical attack from the abrasive containing slurry. Therefore, the anti-corrosive layer 130, and the overlay material 120 are optional.

Because the abrasive particles 50 are firmly held in, or on the brazing alloy sheet 90, the surface tension of the liquid brazing alloy is insufficient to cause particle clustering as shown in FIG. 2. Additionally, braze thickening occurs to a much lesser degree and few or no "mounds" are formed. Rather, the braze forms a slightly concave surface between each abrasive particle, which provides additional structural support. In one embodiment, the thickness of the brazing alloy sheet 90 is predetermined to allow at least about 10 to 90% of each abrasive particle to protrude above the outer, or working, surface of brazing material 90. In another aspect, when the overlay material 120 is used, the abrasive particles may be selected or placed, so that at least about 10 to about 90% of each abrasive particle protrudes above the outer, or working, surface of the overlay material 120.

As a result of the methods for maintaining the abrasive particles 50 in a fixed position during processing, even spaces may be created between abrasive particles. Additionally, the abrasive grits may extend to a uniform height or distance above the substrate 40, which means when applied to a CMP pad, they will protrude to a uniform depth within the pad fibers. The even spacing and uniform protrusion causes the CMP to be dressed or groomed evenly, which in turn increases the polishing efficiency of the CMP pad and extends its useful life. In addition to the specific methods of embedding, or adhering the abrasive particles to the brazing alloy, those skilled in the art will recognize suitable alternative procedures, such as fixing the abrasive particles to the substrate, and then placing the braze thereon. In this case, the particles may be positioned on the substrate using the template method recited above, and held in place by a glue, or other suitable binder. The braze material is then showered, or placed on the substrate around the abrasive particles, and the overlay material may be added.

Although the present invention encompasses a wide variety of patterns for abrasive particle placement which may be created using the method described above, one aspect of the present invention is the recognition of specific predetermined patterns that more adequately meet the particular needs and conditions for which CMP pad dressers are used. In order to accomplish such patterns, each grit is positioned and held at a specific location in accordance with the design of the pattern. Such patterns are indeed useful for achieving specific CMP pad dressing results, and may be varied in order to achieve a specific grooming result as will be seen.

For example, the grooming results of many known pads could be improved by placing grits in a certain configuration. Particularly, as CMP pads are flexible, the downward pressure exerted by the dresser causes the pad to rise or mound as it comes in contact with the leading edge of the dresser that is moving in a given direction. While the rising action may improve the dressing of the pad at the leading edge of the dresser as it allows a fuller contact with the abrasive particles, it may also cause a dipping action in the portion of the pad that has already passed under the leading edge of the dresser. Even if no dipping occurs, generally, the dressing action of the remaining portion of the dresser behind the leading edge is less effective than that of the leading edge (i.e. the first row of abrasive particles encountered by the pad as dictated by the directional movement of the dresser, or the spinning CMP pad, or both), because the pad is not allowed to rise again once underneath the dresser. As such, the majority of the dressing burden is placed on the abrasive particles at the leading edge of the dresser, and uneven particle wear occurs.

Penetration depth of each particle is primarily controlled by two factors, separation distance from other particles and protrusion height. Sparsely spaced particles will dress more aggressively than densely populated ones. Therefore, in one aspect of the present invention, the pattern of abrasive particles may be configured to allow the CMP pad to rise while underneath the dresser at an interior or central location (i.e. a location that follows a leading edge), thus allowing them to be dressed by abrasive particles following those of the leading edge. In effect, such a configuration provides a multiplicity of leading edges along the working surface of the dresser. In other words, the particles on the periphery have a higher density than the density of the centrally located particles. The density of the periphery particles can be at least about 1.25, 2, or 5 times greater than the density of the central particles. Further the density can be a gradient of high at the periphery particles and low at the central particles. In this manner, the various densities allow the CMP pad is to rise while under a central portion of the pad dresser, and increase dressing effectiveness. As will be seen, a variety of particle configurations or patterns can provide the required spacing of abrasive particles to achieve such actions and be used to achieve specifically desired dressing results.

Figure 9:
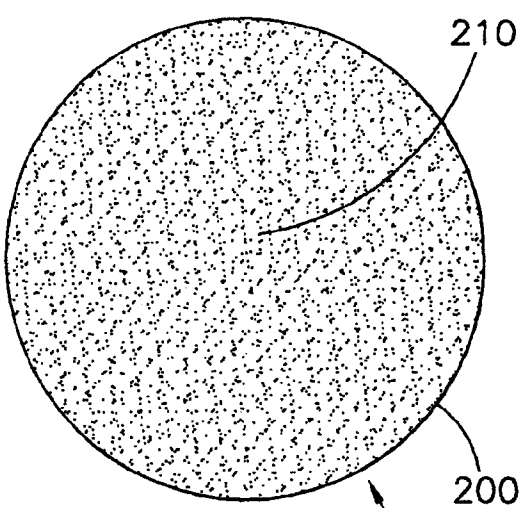
FIG. 9 is a top view of the working surface of a CMP pad dresser having abrasive particles coupled to the substrate such that the particles are uniformly distributed throughout, in accordance with one embodiment of the present invention.
Figure 8:
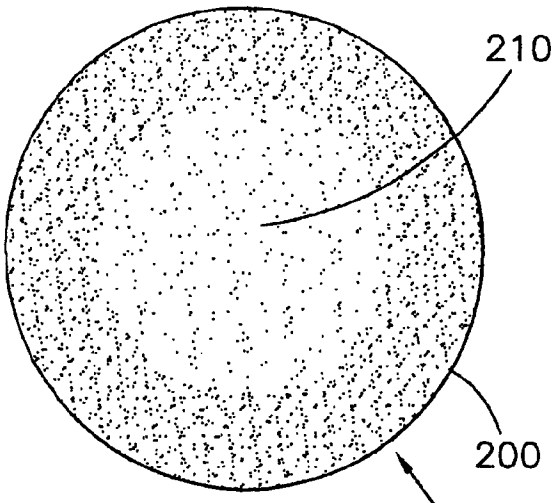
FIG. 8 is a top view of the working surface of a CMP pad dresser having abrasive particles coupled to the substrate such that more of the particles are at the leading edge than at the center, in accordance with one embodiment of the present invention.
Figure 7:
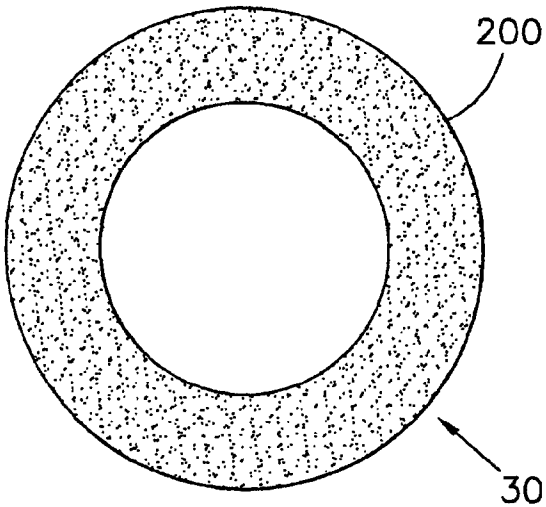
FIG. 7 is a top view of the working surface of a CMP pad dresser having abrasive particles coupled to the substrate such that abrasive particles present substantially only along the leading edge of the dresser, in accordance with one embodiment of the present invention.

As illustrated by way of example in FIG. 7, in one aspect of the invention, the abrasive particles may be arranged so as to have abrasive particles located only along the leading edge 200 of the pad dresser 30. Referring now to FIG. 8, in another aspect of the invention, the abrasive particles may be arranged to be more highly concentrated (i.e. have a higher density) along the leading edge 200 than in the center 210. By contrast, in a further aspect of the invention, the abrasive particles may be arranged such that the abrasive particles are more concentrated in the center than along the leading edge (not illustrated). In still another aspect, the particles may be arranged and distributed at a higher concentration in the central portion of the pad dresser than the particles at the periphery. Further, the particles located between the central and peripheral portions are arranged to have a density that is between the densities of the central portion and periphery portion. Referring now to FIG. 9, in yet another aspect of the invention, the abrasive particles may be arranged such that the they are uniformly distributed with a space between each particle that is sufficient to allow the afore-discussed pad rising. In one aspect, the uniformly distributed particles may form a grid and be evenly spaced at a distance of about 1.5 to about 10 times the size of each individual grit. As will be recognized by those skilled in the art, the abrasive particles may also be arranged in various concentration gradients increasing or decreasing in concentration from the leading edge toward the center of the CMP pad dresser (not illustrated).

In another embodiment, the present invention provides a method that increases the work load on centrally located superabrasive particles in a CMP pad dresser during dressing of a CMP pad with the dresser. The method configures superabrasive particles to in a pattern that reduces penetration of peripherally located particles into the CMP pad and increases penetration of centrally located particles into the CMP pad dresser. In some aspects, the superabrasive particles are each individually located at specific positions on the CMP pad substrate in accordance with the predetermined pattern. The work load on the centrally located particles can be increased to within at least about 10% to about 30% of the work load of the peripherally located particles. The work load can further be substantially equal with the work load of the peripheral particles or all particles.

Figure 10:
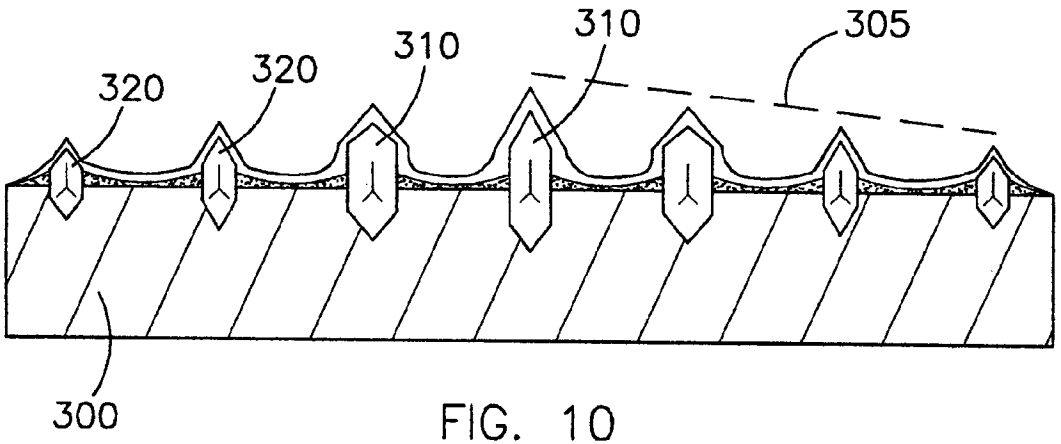
FIG. 10 is a side view of a CMP pad dresser made in accordance with one embodiment of the present invention.

Increasing the work load on the centrally located particles can be accomplished in several ways. For example, the superabrasive particles can be configured in a pattern that provides an upward slope from working ends of the peripheral particles to the working ends of the central particles, as illustrated in FIG. 10. Another alternative for increasing the work load is affixing the superabrasive particles in a pattern which provides a density of peripherally located particles higher than the density of centrally located particles, as described above. Finally, the pattern can be configured to provide centrally located particles with an attitude that causes higher particle penetration into the CMP pad than the penetration provided by the attitude of the peripherally located particles, as illustrated in FIG. 11.

With reference to FIG. 10, the present invention provides a CMP pad dresser which increases the work load on the centrally located superabrasive particles by providing a substrate 300 coupled to superabrasive particles having an upward slope 305 from the peripheral superabrasive particles 320 to the centrally located particles 310. The upward slope can be created by increasing the particle height from the particles located on the periphery to the particles located centrally. As a result, the upward slope transfers the work load from the peripheral particles to the central particles by providing a fuller contact with the central particles and the CMP pad. The increased contact improves the dressing of the CMP pad and the total wear of the pad conditioner. The slope is determined as a measure of pad velocity and pad flexibility. Generally, the pad is a deformable medium which depresses when it comes in contact with the leading edge particles. Normally, the depression of the pad will intensify depending on the flexibility of the pad and the rotational speed of the pad. In a preferred embodiment of the present invention the slope is from about 0.1% to 0.5%, preferably the slope is 0.2%.

As an alternative, the slope may be obtained by the altering the configuration of the substrate. As shown in FIG. 10, the substrate of the CMP pad dresser is substantially flat, however, in some aspects, the substrate may be contoured to conform to the depression of the rotating CMP pad. Such contour may provide the desired slope for the working ends of the abrasive particles 310 and 320. In such a case, the height of the particles above the working surface of the substrate will be substantially uniform. The substrate is usually made of a metallic, ceramic, or flexible material. In a one embodiment the substrate can be stainless steel. In some aspects, the substrate can be a powdered material that becomes a solid upon processing. In further aspects, the powder may include a brazing alloy of a metal such as nickel in combination with a carbide forming element, such as chromium in an amount of at least about 2 wt %. In some aspects, the substrate Further, the substrate can consist essentially of a brazing material.

Figure 11:
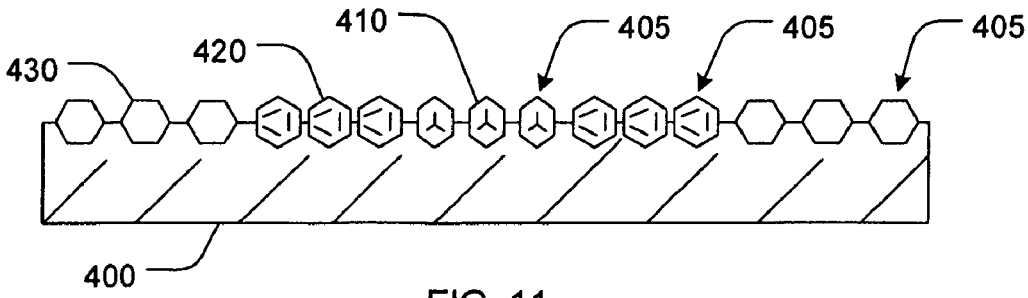
FIG. 11 is a side view of a CMP pad dresser made in accordance with one embodiment of the present invention.

FIG. 11 is an illustration of a CMP pad dresser which increases the work load on centrally located particles of a CMP pad dresser while dressing a CMP pad. Abrasive particles wear at different rates depending on the attitude of the particle. Generally, the attitude of an apex will provide more penetration into the CMP pad and will groom more aggressively than the other attitudes. A particle which has an attitude of a face provides the least amount of penetration and is the least aggressive in dressing the pad. A particle having an edge as an attitude provides intermediate grooming and penetration characteristics. Referring to FIG. 11, a substrate 400 receives a plurality of superabrasive particles 410, 420, 430 in a predetermined pattern. The pattern is configured to provide centrally located particles with an attitude that causes higher particle penetration into the CMP pad than penetration provided by an attitude of particles located at the periphery of a pad dresser. The centrally located superabrasive particles 410 are oriented in an attitude that provides an apex at the working end 405 of the particles. These particles groom the pad more aggressively and have a higher degree of penetration than the attitude provided by the other particles. The peripheral particles 420 can be oriented in an attitude that provides either an edge or a face 430 at the working end 405 thereof. Notably, as shown in the embodiment of FIG. 11, when the centrally located particles are oriented in an attitude that provides an apex at the working end 405 thereof, and the attitude of the periphery particles 430 is a face at the working end 405 thereof, any particles 420 therebetween can be oriented in an attitude that provides an edge at the working end thereof. However, in other typical embodiments, any particles located between those of the periphery and those of the center will be the same as the either of the other types. In one additional embodiment (not shown) the centrally located particles may be oriented in an attitude that provides an edge at the working end thereof and the peripherally located particles may be oriented in an attitude that provides a face at the working end thereof.

In addition to the above recited methods and devices, the present invention provides a method of producing a CMP pad dresser as described herein. In one aspect, such a method includes the steps of providing a substrate and attaching superabrasive particles to the substrate in a pattern that reduces penetration of peripherally located particles into the CMP pad and increases penetration of centrally located particles into the CMP pad.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

The invention claimed is:

1. A method of increasing work load on centrally located superabrasive particles in a CMP pad dresser during dressing of a CMP pad with the dresser comprising:

configuring the superabrasive particles in a pattern that reduces penetration of peripherally located particles into the CMP pad and increases penetration of centrally located particles into the CMP pad.

2. The method of claim 1, wherein the pattern of superabrasive particles provides an upward slope from working ends of the peripherally located particles to working ends of the centrally located particles.

3. The method of claim 2, wherein the slope is provided by increasing particle height from the peripherally located particles to the centrally located particles above a working surface of the dresser.

4. The method of claim 2, wherein the slope is determined as a measure of pad velocity and flexibility.

5. The method of claim 2, wherein the slope is from about 0.1% to about 0.5%.

6. The method of claim 5, wherein the slope is about 0.2%.

7. The method of claim 1, wherein the pattern of superabrasive particles provides a density of peripherally located particles that is higher than a density of centrally located particles.

8. The method of claim 7, wherein the density of the peripherally located particles is at least about 5 times greater than the density of the centrally located particles.

9. The method of claim 7, wherein the density of the peripherally located particles is at least about 2 times greater than the density of the centrally located particles.

10. The method of claim 7, wherein the density of the peripherally located particles is at least about 1.25 times greater than the density of the centrally located particles.

11. The method of claim 7, wherein superabrasive particles between the centrally and peripherally located particles are placed at a density that is between the density of the centrally located particles and the peripherally located particles.

12. The method of claim 7, wherein the pattern of superabrasive particles provides a substantially continuous density gradient of high at the peripherally located particles to low at the centrally located particles.

13. The method of claim 1, wherein the pattern of superabrasive particles provides centrally located particles with an attitude that causes greater particle penetration into the CMP pad than penetration provided by an attitude of the peripherally located particles.

14. The method of claim 13, wherein the attitude of the centrally located particles is an apex at the working end thereof, and the attitude of the peripherally located particles is either an edge or a face at the working end thereof.

15. The method of claim 13, wherein the attitude of the centrally located particles is an edge at the working end thereof, and the attitude of the peripherally located particles is a face at the working end thereof.

16. The method of claim 13, wherein the attitude of the centrally located particles is an apex at the working end thereof, and the attitude of the peripherally located particles is a face at the working end thereof, and any particles therebetween have an attitude of an edge at the working end thereof.

17. The method of any of claims 1, 2, 7, or 13, wherein the work load of the centrally located particles is increased to within at least about 30% of the work load of the peripherally located particles.

18. The method of claim 17, wherein the work load of the centrally located particles is increased to within at least about 10% of the work load of the peripherally located particles.

19. The method of claim 17, wherein the work load of the centrally located particles is increased to be substantially equal with the work load of the peripherally located particles.

20. The method of claim 17, wherein the work load of all particles is substantially equal.

21. The method of either of claims 2 or 13, wherein the superabrasive particles are each individually located at specific positions on a substrate in accordance with a predetermined pattern.

22. The method of claim 21, wherein the pattern is a substantially uniform grid.

23. The method of any of claims 1, 2, 7, or 13, wherein said superabrasive particles are selected from the group consisting of: diamond, polycrystalline diamond (PCD), cubic boron nitride (cBN), and polycrystalline cubic boron nitride (PCBN).

24. The method of claim 23, wherein said superabrasive particles are diamond.

25. The method of any of claims 1, 2, 7, or 13, further comprises the step of providing a substrate to which the superabrasive particles are coupled.

26. The method of any of claims 25, wherein said superabrasive particles are coupled to a substrate by brazing, sintering, or electroplating.

27. The method of any of claims 1, 2, 7, or 13, wherein said superabrasive particles have a substantially uniform shape.

28. The method of claim 27, wherein said uniform shape is euhedral.

29. The method of claim 27, wherein said uniform shape is octahedral.

30. The method of any of claims 25, wherein the substrate is made of flexible, metallic, or ceramic material.

31. The method of claim 30, wherein said metallic material is stainless steel.

32. A CMP pad dresser comprising:

a substrate; and a plurality of superabrasive particles attached to the substrate, wherein said superabrasive particles are configured in a predetermined pattern that provides an upward slope from working ends of the peripherally located particles to working ends of the centrally located particles.

33. A CMP pad dresser comprising:

a substrate; and a plurality of superabrasive particles attached to the substrate, wherein said superabrasive particles are configured in a predetermined pattern that provides a density of peripherally located particles that is higher than a density of centrally located particles.

34. A CMP pad dresser comprising:

a substrate; and a plurality of superabrasive particles attached to the substrate, wherein said superabrasive particles are configured in a predetermined pattern that provides centrally located particles with an attitude that causes higher particle penetration into the CMP pad than penetration provided by an attitude of the peripherally located particles.

35. The CMP pad dresser of claim 32, wherein the slope is provided by increasing particle height from the peripherally located particles to the centrally located particles above a working surface of the dresser.

36. The CMP pad dresser of claim 32, wherein the slope is determined as a measure of pad velocity and flexibility.

37. The CMP pad dresser of claim 32, wherein the slope is from about 0.1% to about 0.5%.

38. The CMP pad dresser of claim 32, wherein the slope is about 0.2%.

39. The CMP pad dresser of claim 33, wherein the density of the peripherally located particles is at least about 5 times greater than the density of the centrally located particles.

40. The CMP pad dresser of claim 33, wherein the density of the peripherally located particles is at least about 2 times greater than the density of the centrally located particles.

41. The CMP pad dresser d of claim 33, wherein the density of the peripherally located particles is at least about 1.25 times greater than the density of the centrally located particles.

42. The CMP pad dresser of claim 33, wherein superabrasive particles between the centrally and peripherally located particles are placed at a density that is between the density of the centrally located particles and the peripherally located particles.

43. The CMP pad dresser of claim 33, wherein the pattern of superabrasive particles provides a substantially continuous density gradient of high at the peripherally located particles to low at the centrally located particles.

44. The CMP pad dresser of claim 34, wherein the attitude of the centrally located particles is an apex at the working end thereof, and the attitude of the peripherally located particles is either an edge or a face at the working end thereof.

45. The CMP pad dresser of claim 34, wherein the attitude of the centrally located particles is an edge at the working end thereof, and the attitude of the peripherally located particles is a face at the working end thereof.

46. The CMP pad dresser of claim 34, wherein the attitude of the centrally located particles is an apex at the working end thereof, and the attitude of the peripherally located particles is a face at the working end thereof, and any particles therebetween have an attitude of an edge at the working end thereof.

47. The CMP pad dresser of any of claims 32, 33, or 34, wherein the work load of the centrally located particles is increased to within at least about 30% of the work load of the peripherally located particles.

48. The CMP pad dresser of claim 47, wherein the work load of the centrally located particles is increased to within at least about 10% of the work load of the peripherally located particles.

49. The CMP pad dresser of claim 47, wherein the work load of the centrally located particles is increased to substantially equal with the work load of the peripherally located particles.

50. The CMP pad dresser of claim 47, wherein the work load of all particles is substantially equal.

51. The CMP pad dresser of either of claims 32 or 34, wherein the superabrasive particles are each individually located at specific positions in accordance with a predetermined pattern.

52. The CMP pad dresser of claim 51, wherein the pattern is a substantially uniform grid.

53. The CMP pad dresser of any of claims 32, 33, or 34, wherein said superabrasive particles are selected from the group consisting of: diamond, polycrystalline diamond (PCD), cubic boron nitride (cBN), and polycrystalline cubic boron nitride (PCBN).

54. The CMP pad dresser of claim 53, wherein said superabrasive particles are diamond.

55. The CMP pad dresser of any of claims 32, 33, or 34, wherein said superabrasive particles are attached to the substrate by brazing, sintering, or electroplating.

56. The CMP pad dresser of claims 32, 33, or 34, wherein said superabrasive particles have a substantially uniform shape.

57. The CMP pad dresser of claim 56, wherein said uniform shape is euhedral.

58. The CMP pad dresser of claim 56, wherein said uniform shape is octahedral.

59. The CMP pad dresser of claim 56, wherein said uniform shape is cubo-octahedral.

60. The CMP pad dresser of any of claims 32, 33, or 34, wherein said substrate is made of a flexible, metallic, or ceramic material.

61. The CMP pad dresser of claim 60, wherein said metallic material is stainless steel.

62. A method of making a CMP pad dresser as recited in any one of claims 32–34, comprising the steps of:

providing a substrate; and attaching a plurality of superabrasive particles to the substrate in a pattern that reduces penetration of peripherally located particles into the CMP pad and increases penetration of centrally located particles into the CMP pad.

* * * * *